United States Patent [19]

Gien et al.

[11] 3,970,153

[45] July 20, 1976

[54] PNEUMATIC PERCUSSION MACHINES

[76] Inventors: Abraham Gien; Bernard Lionel Gien, both of P.O. Box 196, Swartruggens, Transvaal, South Africa

[22] Filed: Jan. 20, 1975

[21] Appl. No.: 542,411

[52] U.S. Cl. ..... 173/17; 91/234; 91/325; 173/66; 173/136

[51] Int. Cl.[2] ..... E21B 1/06

[58] Field of Search ..... 173/16, 17, 1, 66, 136; 91/234, 325

[56] References Cited

UNITED STATES PATENTS

| | | | |
|---|---|---|---|
| 629,967 | 8/1899 | Peck et al. | 173/136 X |
| 727,954 | 5/1903 | Iler | 173/136 |
| 870,178 | 11/1907 | Johnson | 91/234 X |

*Primary Examiner*—Ernest R. Purser
*Attorney, Agent, or Firm*—Haseltine, Lake & Waters

[57] ABSTRACT

A pneumatic percussion machine such as a drill, having a piston reciprocating in a casing, chambers formed in casing at or towards the ends of the piston, the arrangement permitting compressed air to be supplied alternatively to the chambers, the compressed air to the one chamber being supplied through a projecting member located co-axially in the casing and over which the piston reciprocates and compressed air from the other chamber being exhausted through the projecting member to the other chamber.

5 Claims, 5 Drawing Figures

PNEUMATIC PERCUSSION MACHINES

FIELD OF THE INVENTION

This invention relates to pneumatic percussion machines. Such machines include, for instance, pneumatic drills, hammers and the like.

BACKGROUND OF THE INVENTION

Generally pneumatic percussion machines comprise a hollow steel casing or cylinder, one end of which is closed off with a valve assembly through which compressed air is supplied to the piston face while the other end is closed off with a bit assembly.

Various arrangements have been proposed for bringing about reciprocation of the piston in the casing. An object of the present invention is the provision of a pneumatic percussion machine which it is believed will have advantages over many known arrangements.

According to the invention, there is provided a pneumatic percussion machine including:

- a hollow casing;
- a valve assembly at one end of the casing;
- a bit assembly at the other end of the casing;
- a piston located in the casing and having an axially disposed bore extending the length of the piston;
- a projecting member extending from the valve assembly into the bore of the piston and along which member the piston is adapted to reciprocate;
- a first chamber formed between an end of the piston and the valve assembly;
- a second chamber formed at or towards the other end of the piston between the piston and the casing;
- a first fluid supply path through the valve assembly to the first chamber;
- a second fluid supply path extending for portion of its length through the valve assembly and projecting member and, for the remaining portion of its length through the piston to the second chamber, such portions of the second fluid supply path being brought into communication with each other over a limited range of positions of the piston along the projecting member; and
- a fluid exhaust path from the first chamber through the projecting member into the bore of the piston and then out through the casing end fitted with the bit assembly, such fluid exhaust path being open over a limited range of positions of the piston along the projecting member; the piston being adapted to move, as the valve assembly opens alternatively the first and second fluid supply paths, between a first position in which:
- it is in contact with the bit assembly;
- the second fluid path is open to the second chamber; and
- the fluid exhaust path is open; and a second position, displaced towards the valve assembly from the first position, in which the first fluid supply path is open to the first chamber.

The piston may be adapted to move to a third position, displaced towards the bit assembly from the piston's first position in which the portion of the second fluid path contained in the valve assembly and the projecting member is open to the first chamber and in which the fluid exhaust path is open. A bit forming part of the bit assembly may be adapted to move between a first position in which it is in contact with the piston in the latter's first position and a second position, displaced from its first position towards the casing end containing such bit assembly, in which the piston is in its third position.

Further according to the invention, a valve assembly includes a clapper valve adapted to open, during operation of the machine, the first fluid supply path during at least part of the movement of the piston from its second position to its first position and to open the second fluid path for at least part of the movement of the piston from its first position to its second position.

Also according to the invention, at least one of the fluid supply paths is open in the piston's third position.

DESCRIPTION OF THE DRAWINGS

By way of example only, a preferred form of the invention will now be described with reference to the accompanying drawings in which.

Figure 1:
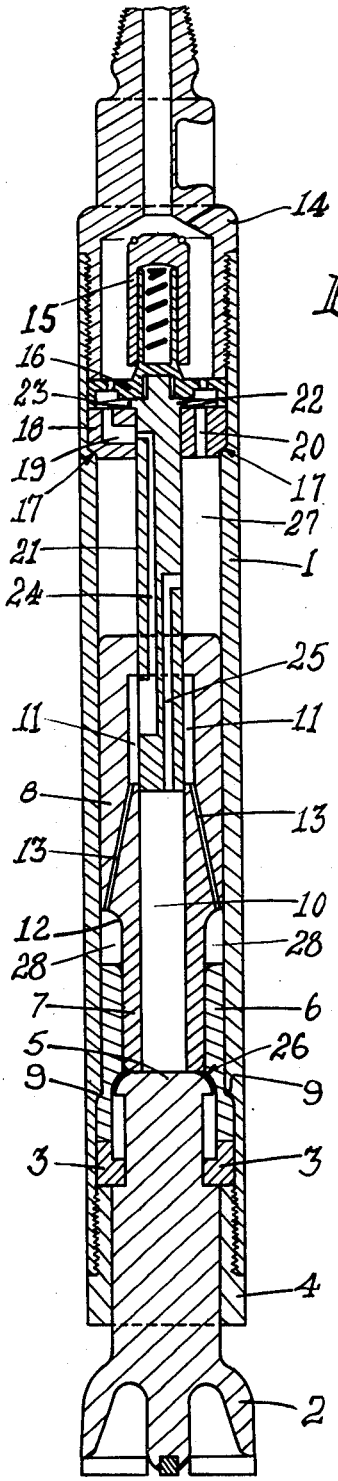
FIG. 1 is a section through the pneumatic percussion drill with a bit assembly of such drill in a first position and a piston thereof in its first position.

DESCRIPTION OF THE ILLUSTRATED EMBODIMENTS.

The pneumatic percussion drill shown in the drawings comprises a hollow casing 1, which is internally tapped at both its extremities. At one end of the casing there is fitted a bit assembly. In the form of the invention shown in the accompanying drawings, such bit assembly includes a bit 2, withdrawal of which is prevented by two retaining half rings 3. These half rings are held in position by a threaded chuck 4 that engages in a tapped end portion of the casing. The upper end of the bit is formed into a suitable striking head 5.

A stem bearing 6 provides a guide for a stepped portion 7 of the piston 8. As will be seen from the accompanying drawings, the stem bearing 6 is stepped to bear against a complementary internal step 9 in the casing as the chuck 4 is tightened.

The piston 8 comprises a stepped metal cylinder which is provided with an axially extending bore 10. Part of the length of such bore is enlarged at a paint intermediate the bore ends to provide a compartment 11. This compartment 11 is connected to the step 12 in the piston 8 by means of two ducts 13, the duct ends opening out into the compartment 11 and the step 12.

The other end of the casing is fitted with a buckhead 14 which engages the casing end in a screw fit. The backhead is fitted with a spring biased check valve 15 located about a projecting stem of a valve chest 16 and adapted automatically to close off the drill interior during non-operation of the drill.

The casing is stepped internally at the end thereof fitted with the backhead assembly, such step 17 being positioned at a point inwardly from the tapped section of such casing end. Against the step 17 there bears a valve seat 18 having two ducts 19 and 20 passing through it.

The valve seat 18 is filled with a projecting member 21 which passes through a hole provided in the seat 18 to extend into the confines of the casing. A peripheral flange 22 is provided towards one end of the projecting member so that on tightening the backhead 14 in the casing end, the projecting member 21 is held tight by the valve chest 16 against the valve seat 18 while the valve seat is pressed firmly against the step 17 in the casing.

The ducts 19 and 20 in the valve seat are opened alternatively by a conventional clapper valve arrangement 23 pivotally mounted on an end of the projecting member 21 and constituting, with the valve seat 18, a valve assembly.

In the projecting member 21 there are formed two ducts, 24 and 25. One duct 24 extends from the duct 19 in the valve seat to a point spaced inwardly from the end of the projecting member. The inlet of the other duct 25 is located midway along the length of the projecting member and its outlet is located in the end wall of the projecting member from where it discharges into the piston bore 10.

The pneumatic percussion drill therefore contains three fluid paths. A first fluid supply path passes through the valve seat into a first chamber formed between an end of the piston and the valve assembly. A second fluid supply path passes through the valve seat, into the projecting member from which it exits at a point intermediate the ends of the projecting member. The remainder of the second fluid path extends from the compartment 11 formed in the bore 10 of the piston to the step 12 in the piston and then into the second chamber formed between the bit assembly and the piston. A third fluid path in this case a fluid exhaust path has its inlet intermediate the ends of the projecting member and its outlet at the end of the projecting member where it discharges into the bore of the piston.

Figure 2:
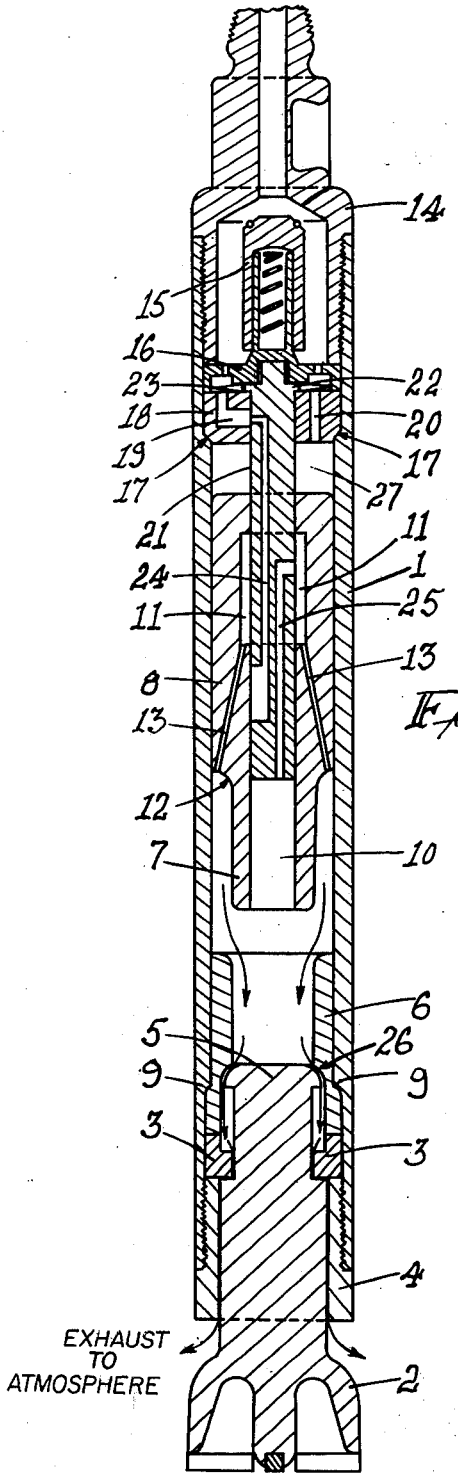
FIG. 2 is a section through the pneumatic percussion drill of FIG. 1 with the bit assembly shown in its first position and the piston removed from the bit.

In operation, the pneumatic percussion drill is rested on its bit 2 to move the bit towards its first position in which its striking head bears against a step 26 in the stem bearing 6. With the clapper valve 23 in the open position for duct 19, compressed air is passed through duct 19 along duct 24 into compartment 11 and then along ducts 13 into second chamber 28. The piston is forced away from its first position as shown in FIG. 1 (in which it is in contact with a bit 2) to its secure position in which the stepped portion 7 moves out of contact with stem bearing 6. Compressed air in the second chamber 28 can now escape past the bit 2 to atmosphere as shown by the arrows in FIG. 2.

At this stage, the clapper valve flips over as a result of the pressure drop in chamber 28 thereby closing duct 19 while at the same time opening duct 20. Compressed air is now passed into chamber 27 where, as a result of the pressure build-up, the piston is forced towards the bit 2. When the piston approaches the first position, air becomes free to exhaust through the fluid exhaust path i.e. through duct 25 into the bore 10 of the piston and then to the exterior of the machine. The clapper valve now flips over again due to the pressure drop in chamber 27 to open duct 19 and close duct 20, thereby to repeat the cycle.

Figure 3:
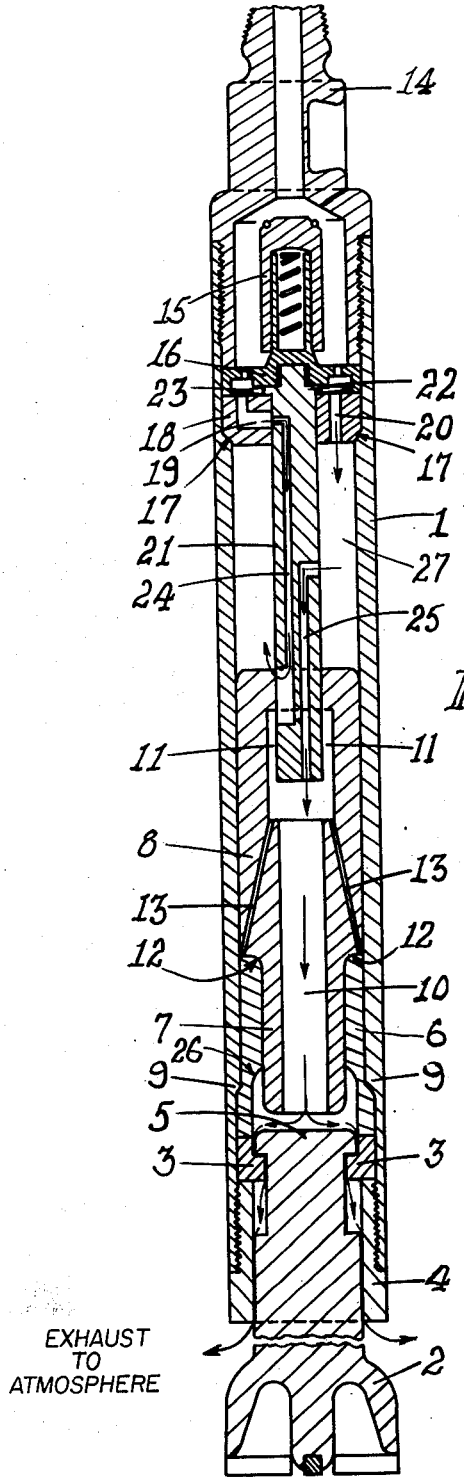
FIG. 3 is a section through the pneumatic percussion drill of FIG. 1 with the bit assembly shown in its third position and the piston in its third position.
Figure 4:
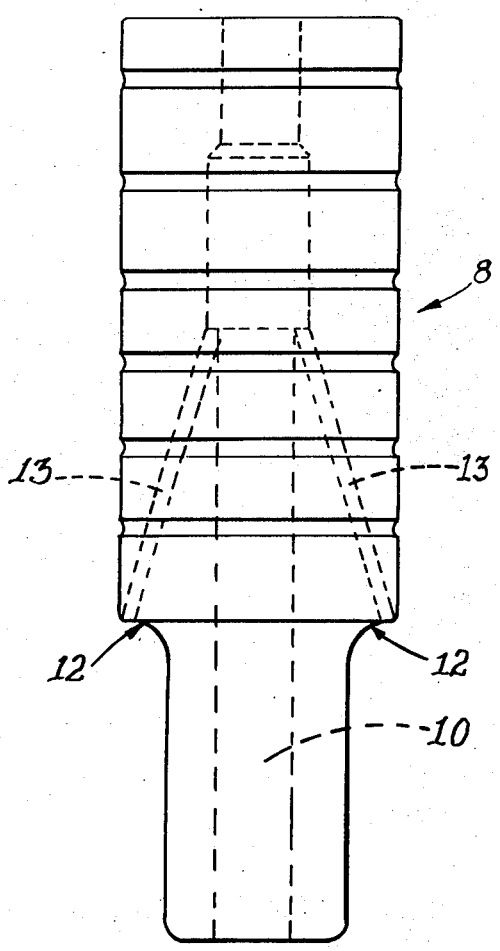
FIG. 4 is a section through a piston forming part of the pneumatic percussion drill of FIG. 1.
Figure 5:
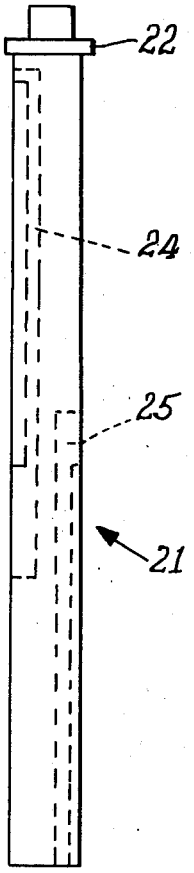
FIG. 5 is a section through a projecting member forming part of the pneumatic percussion drill of FIG. 1.

If, on the other hand, the machine is raised so that the bit drops to a second lower position, as shown in FIG. 3, any compressed air passing down duct 24 exhausts into chamber 27 from where it can escape through duct 25 and bore 10 to the exterior of the machine. At the same time any compressed air entering through duct 20 can escape to the exterior of the machine along the same fluid path. The exhaust paths are shown by the use of arrows in FIG. 3. In this raised condition, the machine is therefore inoperative.

Other forms of the invention exist. The striking head and the bit head may be separate members.

In this latter instance, the striking head and the bit head may interlock releasibly for easy replacement of the bit. The bit head need not therefore form part of the bit assembly. The term "bit assembly" must therefore be interpreted in the sense in which it may or may not include a bit head.

The invention incorporates many advantages. It comprises a minimum number of working parts, thereby lessening the effect of wear. By eliminating the inner sleeve of a valve employed in some conventional machines, a piston of larger diameter, for the same overall diameter of the machine, can be obtained. This in turn allows for a machine having a larger piston face and permits the machine to operate at lower fluid pressure than would normally be the case.

The machine also has the advantage that when it is raised to lift the bit off the work face, the fluid exhaust path is automatically opened to allow compressed air to escape to the atmosphere and thereby stop reciprocation of the piston in the casing.

By virtue of the increased diameter, and hence, mass of the piston, there is an increase in the intensity of the blow imparted by the piston to the striking head. The impact of the blow is also transmitted directly to the bit head.

We claim:

1. A pneumatic percussion machine including:

a hollow casing having opposite ends;

a valve assembly at one end of the casing;

a bit assembly at the other end of the casing;

a piston having opposite ends located in the casing and having an axially disposed bore extending the length of the piston;

a projecting member extending from the valve assembly into the bore of the piston and along which member the piston is adapted to reciprocate;

a first member chamber formed between one end of the piston and the valve assembly;

a second chamber formed in the vicinity of the other end of the piston between the piston and the casing, a first fluid supply path through the valve assembly to the first chamber;

a second fluid supply path extending over a portion of its length through the valve assembly and projecting member and, for the remaining portion of its length, through the piston to the second chamber, such portions of the second fluid supply path being brought into communication with each other over a limited range of positions of the piston along the projecting member; and a fluid exhaust path from the first chamber through the projecting member into the bore of the piston and then out through the casing end fitted with the bit assembly, such fluid exhaust path being open over a limited range of positions of the piston along the projecting member; the piston being movable, as the valve assembly alternatively opens the first and second fluid supply paths, between a first position in which:

the piston is in contact with the bit assembly, the second fluid path is open to the second chamber; and the fluid exhaust path is open; and a second position, displaced towards the valve assembly from the first position, in which the first fluid supply path is open to the first chamber.

2. A pneumatic percussion machine as claimed in claim 1, in which the piston is movable to a third position, displaced towards the bit assembly from the piston's first position, in which the portion of the second fluid path contained in the valve assembly and the projecting member is open to the first chamber and in which the fluid exhaust path is open.

3. A pneumatic percussion machine as claimed in claim 2, in which a bit forming part of the bit assembly is movable between a first position in which the bit is in contact with the piston in the latter's first position and a second position, displaced from its first position towards the casing and containing such bit assembly, in which the piston is in its third position.

4. A pneumatic percussion machine as claimed in claim 3, in which the valve assembly includes a clapper valve which opens, during operation of the machine, the first fluid supply path during at least part of the movement of the piston from its second position to its first position and opens the second fluid path for at least part of the movement of the piston from its first position to its second position.

5. A pneumatic percussion machine as claimed in claim 1 in which at least one of the fluid supply paths is open in said third position of the piston.

* * * * *